United States Patent [19]

Lynch

[11] Patent Number: 4,641,676

[45] Date of Patent: Feb. 10, 1987

[54] COLLAPSIBLE CANOPY STRUCTURE

[76] Inventor: James P. Lynch, 6901 W. 87th Way, #304, Arvada, Colo. 80003

[21] Appl. No.: 573,070

[22] Filed: Jan. 23, 1984

[51] Int. Cl.[4] ..... A45F 1/16; E04H 15/50

[52] U.S. Cl. ..... 135/110; 135/115

[58] Field of Search ..... 135/90, 109, 110, DIG. 2, 135/106, 107, 111, 112, 113; 52/109

[56] References Cited

U.S. PATENT DOCUMENTS

| | | | |
|---|---|---|---|
| 684,130 | 10/1901 | Taubert | 135/110 |
| 1,326,006 | 12/1919 | Sterhardt | 135/109 |
| 1,493,915 | 5/1924 | Baker | 135/109 |
| 1,712,836 | 5/1929 | Mills | 135/110 |
| 1,728,356 | 9/1929 | Morgan | 135/109 |
| 1,853,367 | 4/1932 | Mace | 135/110 |
| 2,135,961 | 11/1938 | Chemoweth | 135/109 |
| 2,440,557 | 4/1948 | Power | 135/90 |
| 2,770,243 | 11/1956 | Miller | 135/109 |
| 2,928,404 | 3/1960 | Klages | 135/109 |
| 3,174,397 | 3/1965 | Sandborn | 52/109 |
| 3,199,518 | 8/1965 | Glidewell | 135/109 |
| 3,335,815 | 8/1967 | Oakes | 52/109 |
| 3,375,625 | 4/1968 | Mikulin | 52/109 |
| 3,496,687 | 2/1970 | Greenberg | 52/109 |
| 3,526,066 | 9/1970 | Hagar | 52/27 |
| 4,156,433 | 5/1979 | Beaulieu | 52/109 |

FOREIGN PATENT DOCUMENTS

| | | | |
|---|---|---|---|
| 1434526 | 12/1968 | Fed. Rep. of Germany | 52/109 |
| 823693 | 1/1938 | France | 135/109 |
| 692885 | 8/1965 | Italy | 135/106 |
| 198803 | 6/1923 | United Kingdom | 135/111 |
| 672815 | 5/1952 | United Kingdom | 135/110 |

*Primary Examiner*—Richard J. Johnson

*Attorney, Agent, or Firm*—Timothy J. Martin

[57] ABSTRACT

A portable canopy structure may be erected from a collapsed state to an expanded state that shelters a desired surface. The canopy structure includes a dome-like covering that is held in position by a support framework having a plurality of upright support members that are interconnected by a plurality of scissor assemblies. Each upright support member slideably mounts a slide bracket, and a rigid bracket is mounted at its top. The scissor assemblies are connected to these brackets. Preferably the structure is in the form of a parallelepiped, and an internal scissor assembly extends between two facing side scissor assemblies which interconnect the upright supports. The covering extends across the tops of the supports and has side panels which depend downwardly from its perimeter, and the internal scissor assembly supports a central post that helps support the covering. A screen may be positioned around the support structure and may be connected to and be downwardly dependent from the side panels. Guy cords may be provided for the upright support members.

5 Claims, 10 Drawing Figures

COLLAPSIBLE CANOPY STRUCTURE

BACKGROUND OF THE INVENTION

The present invention relates to a collapsible canopy structure which is readily portable so that it may be used as a convenient shade screen or shelter, primarily for outdoor activities. The present canopy structure is particularly adaptable to be stored in its collapsed state in a relatively small volume yet which may be expanded to provide a shelter having a large surface area of coverage.

Although portable shelters have been in existence since the earliest of times when nomadic tribes began to spread across the prehistoric plains of the earth, there has been an inreasing need for greater sophistication in the quality and type of construction employed in portable apparatus that provides shelter for the human body. The state of this art has experienced a dramatic period of growth in the last 20 years with new technologies being developed in fabrics, support structure and design for light-weight tents and mountaineering shelters. Despite these advances, little attention has been directed to light-weight, large area shelters which may be stored in a small, collapsed state yet which may be easily expanded with a minimum amount of effort so that a sturdy, large area shelter may be erected.

SUMMARY OF THE INVENTION

It is therefore an object of the present invention to provide a novel, useful and nonobvious portable shelter which may be stored in a relatively, compact state yet which is expandable to cover a large surface area.

It is another object of the present invention to provide an inexpensive collapsible canopy shelter that may easily be erected by a single person.

Yet another object of the present invention is to provide a portable canopy structure which is light in weight yet which can resist strong winds when erected.

A further object of the present invention is to provide a portable canopy structure that is adjustable in height and which is designed for stability.

To accomplish these objects, the present invention comprises a canopy structure which is collapsible into a relatively small volume for storage yet which is expandable to define a canopy of large surface area that may be positioned on any convenient surface, such as the ground, thus providing a shelter against various elements. To this end, the preferred embodiment of the present invention includes a support structure formed by a plurality of upright support members, in the form of legs, which are interconnected to each other, by means of expandable scissor assemblies and by a flexible covering overlaying the tops of the legs.

In the most general form, each upright support member slideably mounts a slide bracket which moves back and forth therealong. Each scissor assembly interconnects a pair of adjacent legs and is defined by a pair of cross connected tubular rods or arms which are pivotally attached to one another at a mid-section to define an X-shaped structure. One end of each arm is secured to a respective slide bracket with the other end of each arm being connected to the top section of an adjacent upright support. Thus, as the upright supports are moved towards each other, both slide brackets move downwardly along their support members so that the crossed arms become more aligned with the upright supports. When the upright supports are moved apart, the slide brackets move upwardly along their respective support members with the crossed arms becoming more perpendicular to the upright supports.

A releasable latch is provided at an upper portion of each support member so as to lock its respective slide bracket at the top section, that is, in the expanded position. A flexible covering is mounted to the top sections of the upright supports and is sized to completely cover the area defined by the tops of the upright supports when they are in the expanded orientation.

Preferably, the framework is in the shape of a rectangular parallelepiped, and the flexible covering has side panels extending downwardly alongside the upright supports so that the covering is in the general shape of a dome. To further support the covering, a scissor assembly, similar to that described above, extends between two opposite sides of the rectangular support framework. This inner scissor assembly mounts a center pole whereby the center of the flexible covering may be elevated and supported. The upright supports may also be provided with telescoping legs and releasable latchs so that they may be adjusted in height. Anchor rings and tether ropes may be utilized to secure the canopy when it is positioned in its expanded position.

These and other objects of the invention will become more readily appreciated and understood from a consideration of the following detailed description of the preferred embodiment when taken together with the accompanyings drawings, in which:

DETAILED DESCRIPTION OF THE PREFERRED EMBODIMENT

Figure 1:
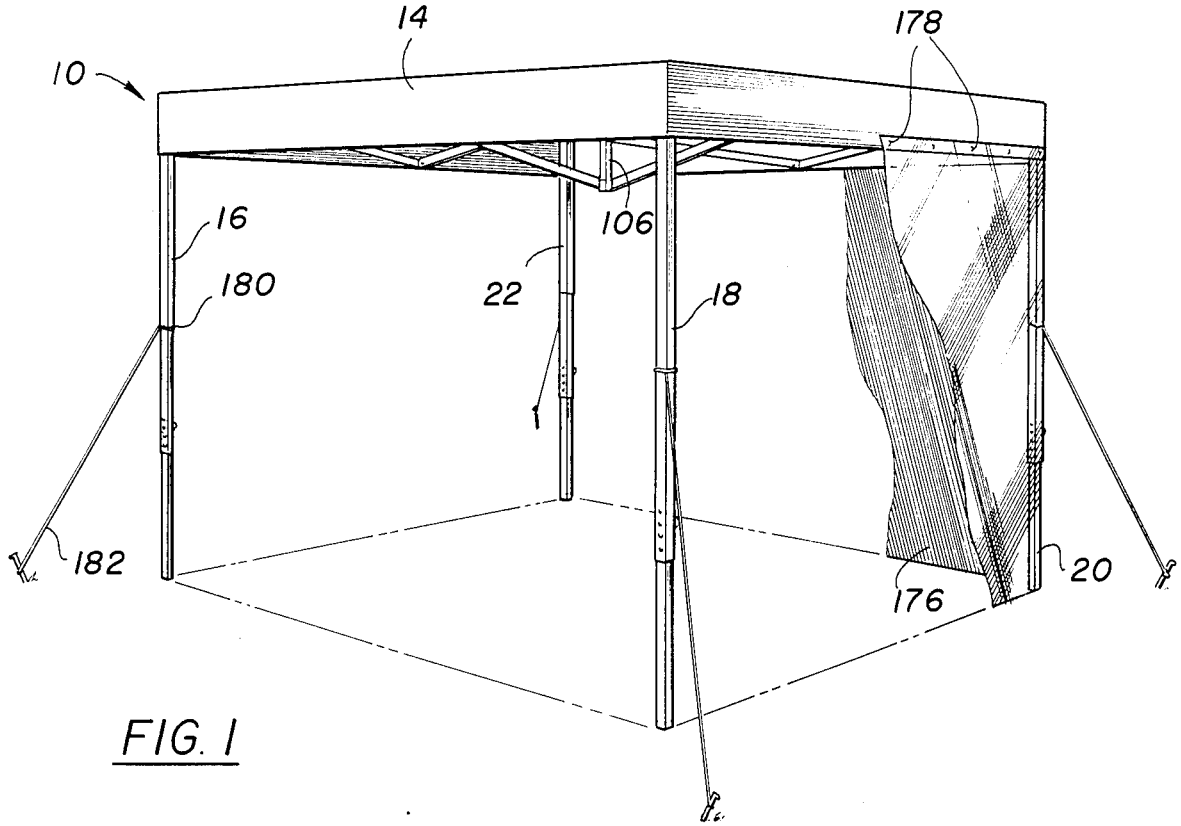
FIG. 1 is a perspective view of the preferred embodiment of the present invention shown in its expanded, upright position.
Figure 3:
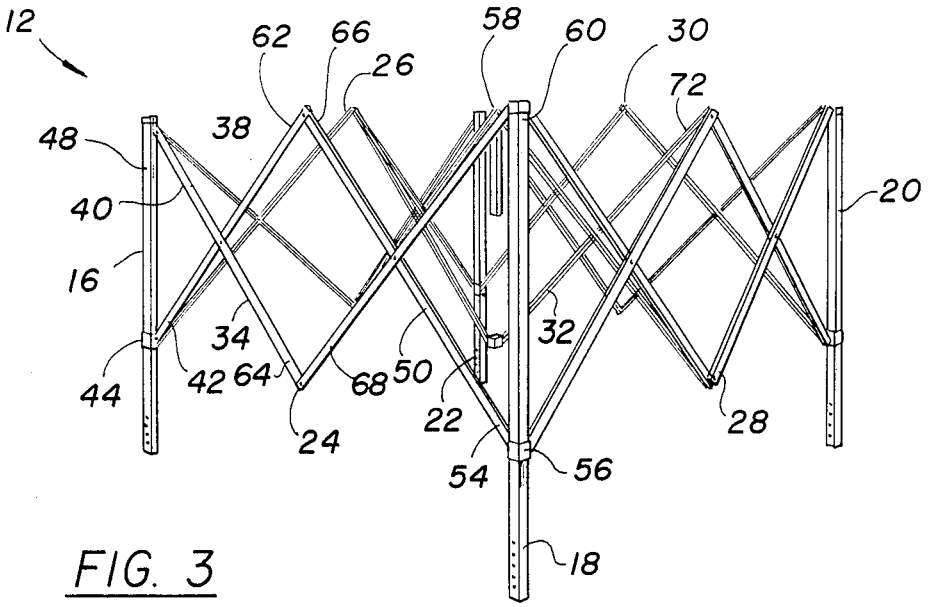
FIG. 3 is a perspective view of the support framework of the preferred embodiment of the present invention shown in an intermediate position between the expanded and collapsed positions.

The present invention is directed to a collapsible, portable canopy shelter that is adapted to be stored in a compact, collapsed state yet which may be easily transported and erected by a single person at a desired location to provide a sturdy shelter against rain, sun and other elements. To this end, the preferred embodiment of the collapsible canopy shelter 10 is shown in its expanded state in FIG. 1 and in its collapsed state in FIG. 2. As is apparent in these figures, canopy shelter 10 generally comprises a support framework 12 constructed of a lightweight, rigid material, such as aluminum, and a flexible, dome-like canopy covering 14 which is held in spaced relation to a surface, such as the ground by support framework 12. As is shown in FIG. 1, canopy shelter 10, when expanded, defines a configuration in the form of a generally cubic user space, but it should be understood that other parallelepiped user spacers are contemplated by the scope of this invention. Support framework 12, without covering 14, is best shown in FIGS. 3 and 3A in an expansion state that is approximately half-way between the collapsed state shown in FIG. 2 and the fully expanded state shown in FIG. 1. As is shown in FIG. 3, support framework 12 includes plurality of upright support members or legs 16, 18, 20, and 22 which form part of the support framework 12 and which are interconnected by scissor assemblies, described below. Specifically, leg 16 is interconnected to its adjacent legs 18 and 22 by means of a pair of scissor assemblies 24 and 26, respectively. Leg 20 is interconnected to its adjacent legs 18 and 22 by means of a third and fourth pairs of scissor assemblies 28 and 30, respectively. In the preferred embodiment, shown in FIG. 3, scissor assemblies 26 and 28, which form opposite sides of support structure 12, are interconnected by a fifth or internal scissor assembly 32. Scissor assemblies 24, 26, 28 and 30 have the same construction so that, for purposes of explanation, only scissor assembly 24 is fully described. However, it should be appreciated that the general structure of each scisor assembly 26, 28 and 30 is the same.

Scissor assembly 24, as is shown in FIG. 3, is defined by a pair of X-shaped scissor units 34 and 36, each of which is formed by a pair of tubular cross arms of square-shaped cross-section. Scissor unit 34 is formed by first elongated arms 38 and 40 which are pivotally attached to one another at a midpoint. Arm 38 is pivotally secured at a first end 42 to a slide bracket 44 that is slidably received on leg 16. A first end 46 of elongated arm 40 is pivotally secured to top 48 of leg 16. Similarly, scissor unit 36 is formed of a pair of elongated arms 50 and 52 which are pivotally attached to one another at their midpoint. A first end 54 of arm 50 is pivotally secured to a slide bracket 56 which is slideably received on leg 18, and a first end 58 of arm 52 is pivotally secured to the top 60 of leg 18. A second end 62 of arm 38 is pivotally connected to a second end 66 of arm 50, and the second end 64 of arm 40 is pivotally connected to second end 68 of arm 52.

Figure 7:
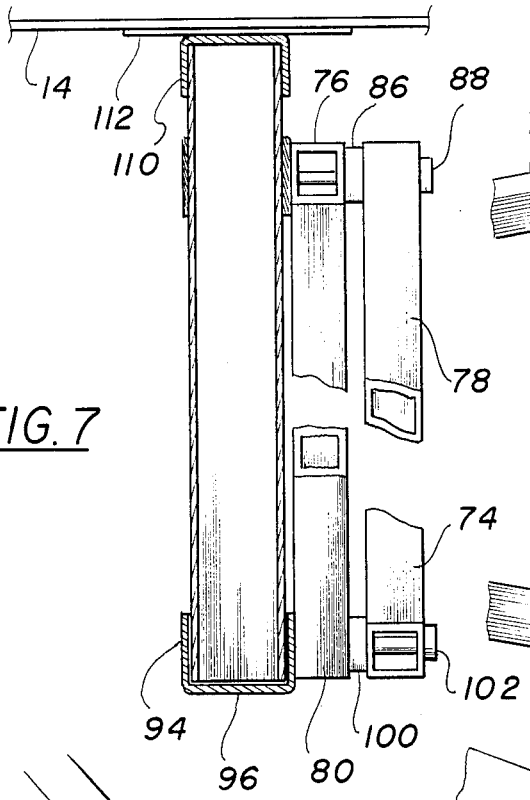
FIG. 7 is a cross-sectional view taken about lines 7—7 of FIG. 6.
Figure 6:
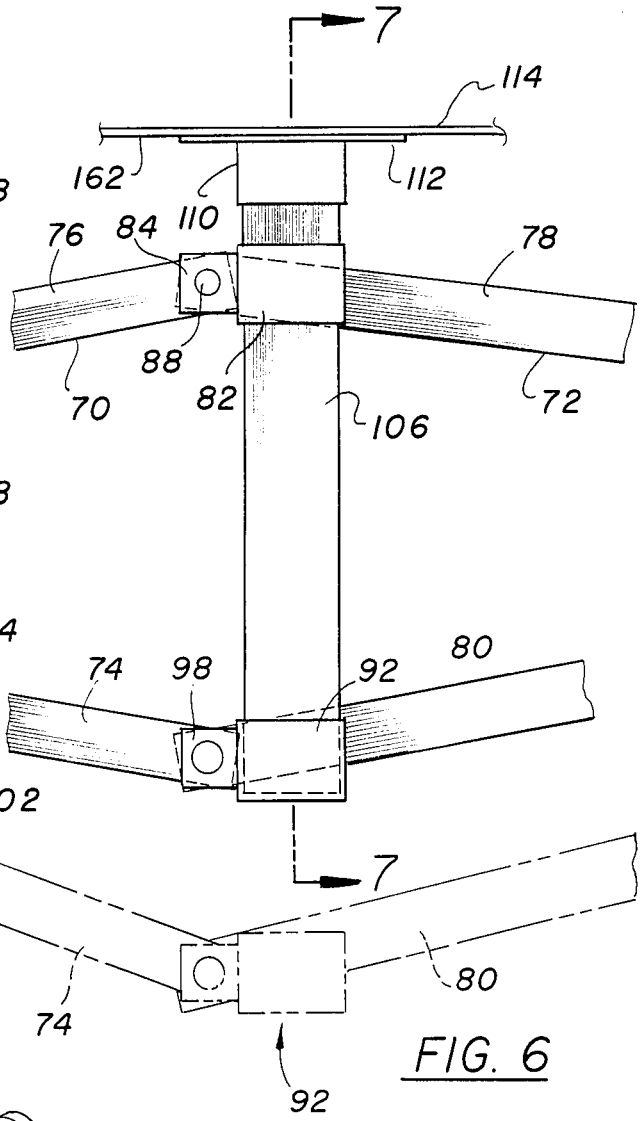
FIG. 6 is a side view in elevation of the center support pole according to the preferred embodiment of the present invention.

Internal scissor assembly 32 is formed by a pair of X-shaped scissor units 70 and 72, as is shown in FIGS. 3 and 3A. The construction of internal scissor assembly 32 is similar to that described above with respect to scissor assembly 24, with the differences in construction best shown in FIGS. 5, 6, and 7. As is shown in those figures, scissor unit 70 is formed by pair of elongated tubular arms 74 and 76 which are hinged together at their mid-sections. Similarly, the scissor unit 72 is formed by a pair of elongated tubular arms 78 and 80 also hinged together at their mid-sections. Scissor units 70 and 72 are connected to one another and to a sleeve 82 and a socket 92. Particularly, sleeve 82 is provided with a tab 84 projecting therefrom. Elongated arms 76 and 78 are pivotally connected to tab 84 by means of a bolt or rivet 88, with a low-friction washer 86 placed between arms 76 and 78.

Socket 92 is cup-shaped in configuration and is defined by surrounding sidewall 94 and a bottom wall 96. Socket 92 includes a tab 98 projecting therefrom which serves to interconnect scissor units 70 and 72. Particularly, elongated arms 74 and 80 are pivotally secured to tab 98 by means of a bolt or rivet 102, with a low-friction washer 100 placed between arms 74 and 80.

Sleeve 82 and socket 92 mount a central or interior post 106 which has a lower end 108 and a cap 110 located on an end thereof opposite end 108. Post 106 extends through sleeve 82 so that end 108 may be mateably and releaseably received by socket 92. When the canopy shelter is moved into the collapsed state, socket 92 disengages from end 108 of post 106, as is shown in phantom in FIG. 6. However, when the canopy shelter is moved into the expanded position, end 108 is positively engaged and supported by socket 92 so that cap 110 is pressed against a reinforcement pad 112 secured to a central portion of covering 14. Preferably, post 106 has a length which is sized to elevate the center of covering 14 slightly higher than the tops of legs 16, 18, 20 and 22 so that water may run off canopy covering 14. In this manner, then, the central portion of covering 14 is supported by post 106 of internal scissor assembly 32.

Figure 5:
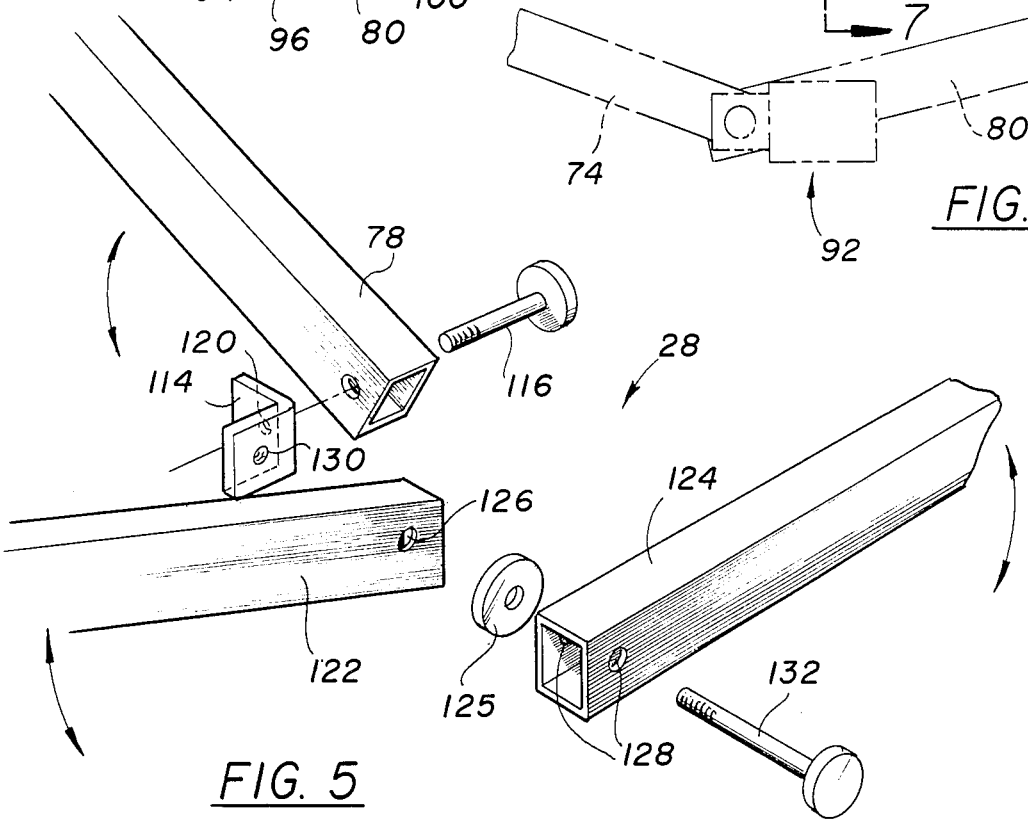
FIG. 5 is an exploded view of a portion of the scissor assembly connections according to the preferred embodiment of the present invention.

A representative connection of internal scissor assembly 32 to a side scissor assembly 28, is shown in FIG. 5. In this figure, an L-shaped bracket 114 is pivotally connected to the end of tubular elongated arm 78 that is opposite the end connected to tab 84 of sleeve 82. Arm 78 is provided with a hole 118 extending therethrough, and L bracket 114 has a complimentary hole 120. A bolt or rivet 116 is then passed through holes 118 and 120, and a bushing may be used to prevent the collapse of the sidewalls of arm 78. Scissor assembly 28 includes elongated tubular arms 122 and 124 which are provided, at adjacent ends, with holes 126 and 128, respectively. L bracket 114 has a second hole 130 which is alignable with holes 126 and 128, and a bolt or rivet 132 extends through these holes so that arms 122 and 124 are pivotally secured to bracket 114 and to each other. A low-friction washer 125 is positioned between arms 122 and 124 on rivet 132. Thus, any scissor movement of scissor assembly 28 causes a corresponding movement to scissor assembly 32.

Figure 4:
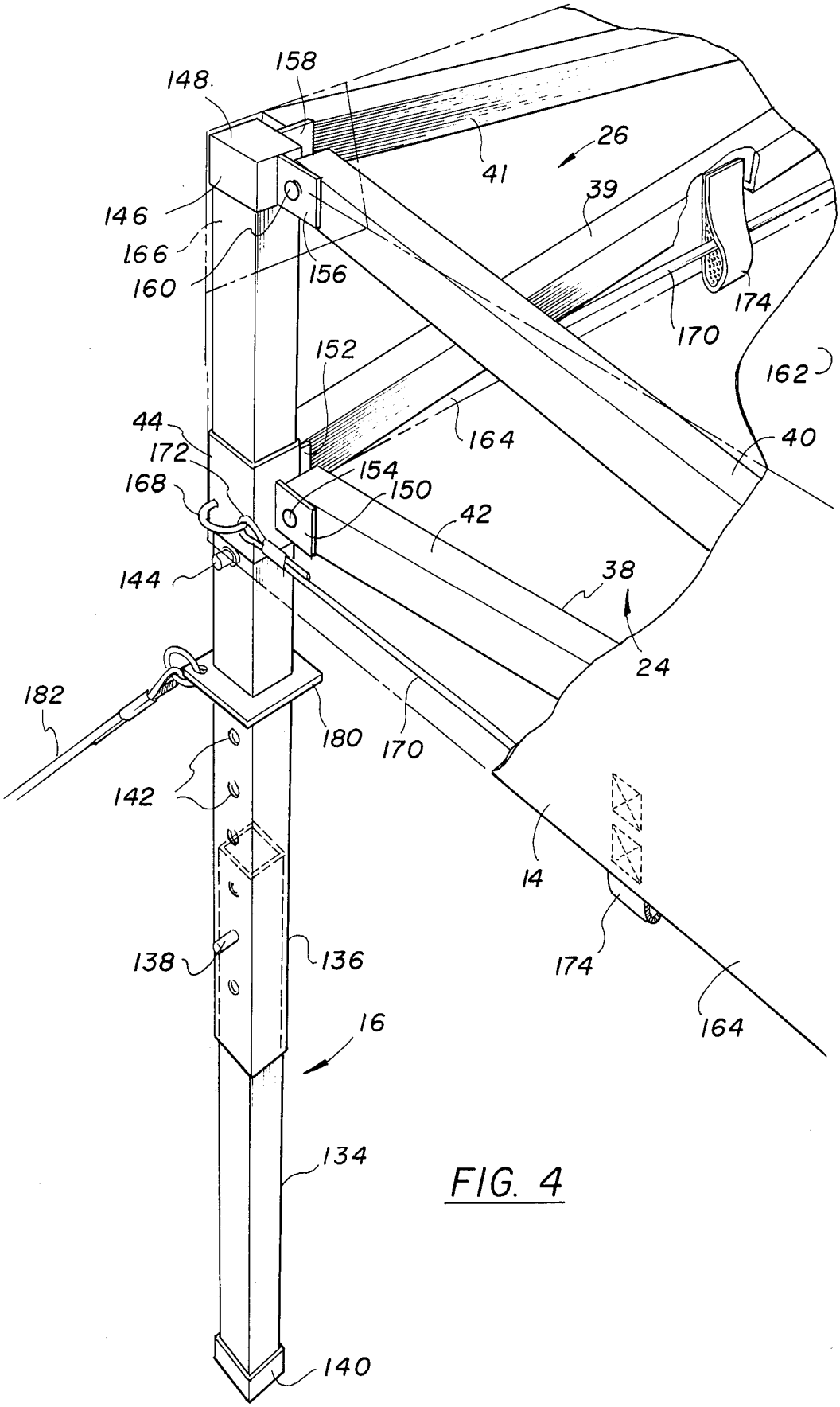
FIG. 4 is a perspective view, partially broken away, of one corner of the preferred embodiment of the present invention in the expanded state.

The construction of the upright supports or legs, and their interconnection to the scissor assemblies is best shown in FIG. 4 where upright support or leg 16 is shown. It should be appreciated that the structure shown in FIG. 4 and described herein corresponds to legs 18, 20 and 22 as well. In FIG. 4, leg 16 comprises a hollow, tubular inner telescoping member 134 and a hollow, tubular outer telescoping member 136 which slideably receives an internal end portion of member 134. The internal end portion of member 134 is provided with a button latch 138, and member 134 terminates in a ground engaging foot or end 140 opposite its internal end. Member 136 is provided with a plurality of holes 142 at its end which receives member 134. Holes 142 are adapted to engage with button latch 138 thereby allowing selective adjustment of the relative positions of telescoping members 134 and 136, as is known in the art.

A second button latch 144 is mounted on a top section of telescoping member 136, and latch 144 is adapted to releaseably retain slide bracket 44 in a locked position with respect to leg 16, this locked position corresponding to the expanded position for canopy shelter 10. A corner bracket 146 is attached to leg 16 at a top end 148 opposite end 140.

Slide bracket 44 and corner bracket 146 are mounted to scissor assemblies 24 and 26. To this end, slide bracket 44 includes a pair of tabs 150 and 152 which project laterally of bracket 44 and at right angles to each other. Elongated arm 38 is pivotally secured to tab 150 by means of bolt or rivet 154, and elongated arm 39 of scissor assembly 26 is pivotally secured to tab 152 in a similar manner. Corner bracket 146 is also provided with a pair of tabs 156 and 158 which laterally project therefrom at right angles to each other. Elongated arm 40 of scissor assembly 24 is pivotally secured to tab 156 by means of a bolt or rivet 160, and elongated arm 41 of scissor assembly 26 is pivotally secured to tab 158 in a like manner.

Covering 14, as is shown in FIG. 4, is defined by a top panel 162 and surrounding side panels 164 are connected to top panel 162 around its perimeter and extend downwardly alongside support framework 12. Thus, top panel 162 and side panels 164 define a dome-liked covering which encases the upper portion of framework 12. A reinforcement panel 166 is provided at each corner bracket 146 to help absorb any stress or tearing forces on covering 14 when canopy shelter 10 is in its expanded position. Preferably, covering 14 is constructed of a flexible, lightweight canvas, nylon or other tent material, as are available in the art.

To further mount covering 14 on support framework 12, a U-ring 168 is provided on slide bracket 44 and a cord 170 is releasably secured to ring 168 by means of a releasable clip 172. Cord 170 extends between adjacent slide brackets on respective legs 16, 18, 20 and 22 and can either be in the form of a single cord extending completely around framework 12 or as discreet cords releasably secured to each slide bracket. Preferably, these cords are formed of an elastic material so that they may lend further rigidity to the canopy shelter. Side panels 164 are provided with flexible connectors 174, such as Velcro strips, and connectors 174 are adapted to be looped around cord 170 so as to prevent unwanted flapping of side panels 164 when canopy shelter 10 is used on windy days. It should be appreciated that other connecting means may be substituted for cord 170 and connectors 172, such as snaps mounted on the scissor assemblies with corresponding snaps being positioned at appropriate locations on the interior surface of side panels 164.

Referring back to FIG. 1, an optional screen 176, such as a mosquito netting, may be releasably retained around the parallelepiped volume defined by support framework 12. Preferably, screen 176 is mounted to a plurality of mateable metal snaps 178 located at its top edge and along its bottom edge of side panels 164, but other fastening devices could be used to connect screen 176 to covering 14. To further stabilize canopy shelter 10, especially on windy days, each leg, such as leg 16, is provided with a locking ring 180 that mounts a guy cord 182 that may be staked into the ground, as is shown in FIG. 1. Locking ring 180 is slideable along leg 16 to its desired position, but, when tension is placed on cord 182, locking ring 180 becomes jammed at the desired location on leg 16, and is known in the art. Slits may be provided at the corner edges of screen 176 so that guy cords 182 may extend therethrough when screen 76 encircles support frame 12.

Figure 2:
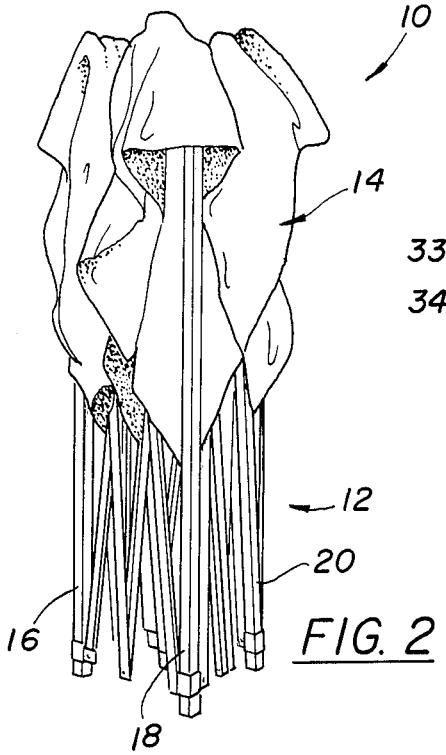
FIG. 2 is a perspective view of the preferred embodiment of the present invention shown in its collapsed position.
Figure 3A:
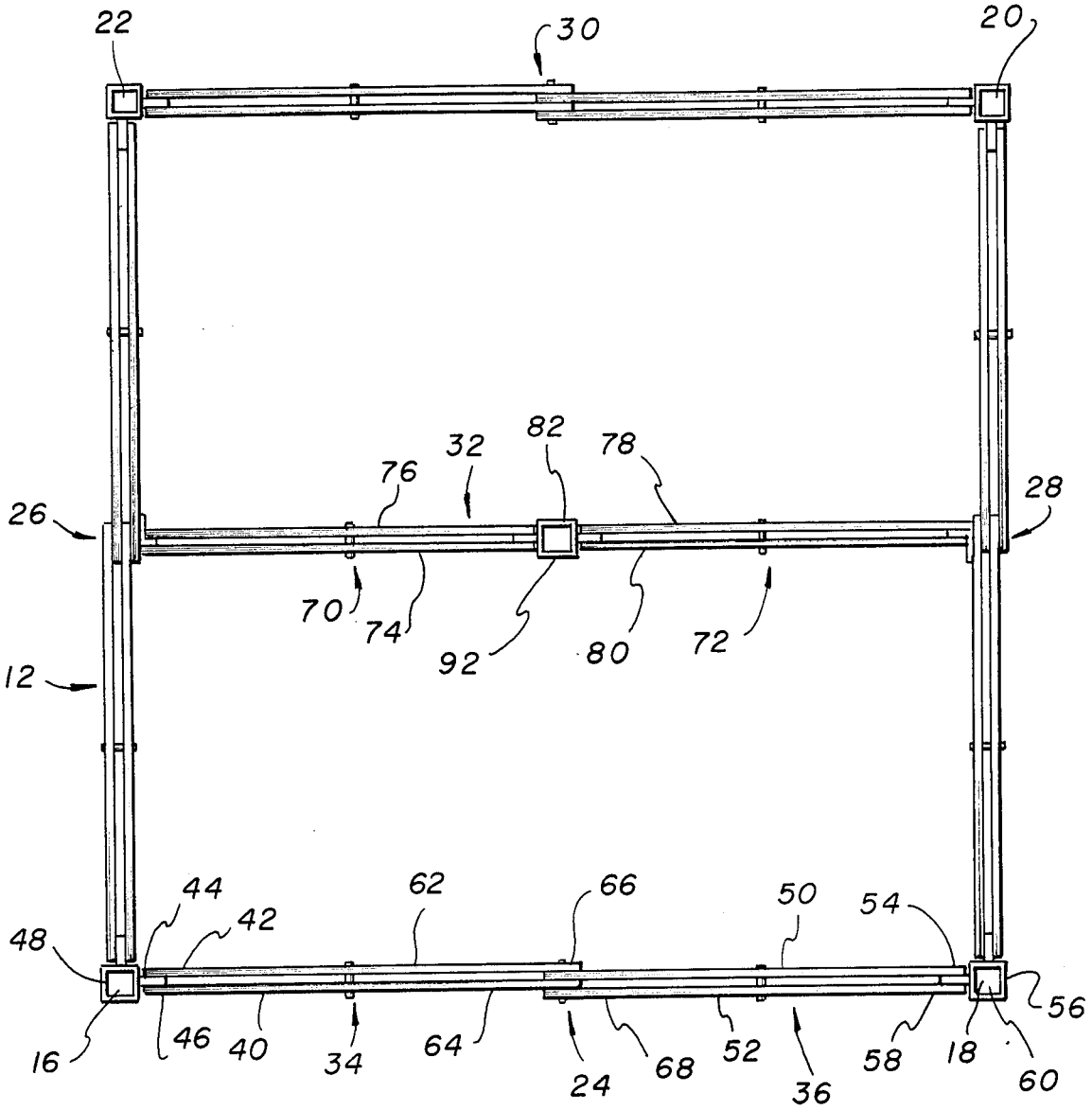
FIG. 3A is a top plan view of the framework shown in FIG. 3.

From the foregoing description, it should be appreciated that the canopy shelter 10 may be moved from a collapsed state, shown in FIG. 2, to the expanded state, shown in FIG. 1, and back again with relative ease. To accomplish this, the user of the present invention simply moves a pair of adjacent legs, such as legs 16 and 18, apart from one another. When this occurs, scissor assembly 24 begins to expand in a lateral direction and, since all of the scissor assemblies are interconnected with one another, scissor assemblies 26, 28 and 30 also move apart from one another, thus separating legs 16, 18, 20 and 22. Each respective side bracket, such as slide bracket 44, is then moved along its support leg until it is adjacent the top sections of its leg where it may be latched into position by means of button latches 144.

As scissor assemblies 24, 26, 28 and 30 move into the expanded position, it should also be appreciated that scissor assembly 32 is forced to expand so that socket 92 is moved toward sleeve 82. As this takes place, lower end 108 of post 106 is positioned in socket 92 so that bottom wall 96 positively supports cap 110 against covering 14. Thus, the central portion of covering 14 is supported by post 106.

After support framework 12 is moved into the expanded position, the user may then conveniently adjust the height of covering 14 above the ground by selectively telescoping the leg sections, such as telescoping members 134 and 136, into a desired orientation and then locking them into their relative orientation by means of button latches 138. After canopy shelter 10 is positioned in its desired configuration, screen 176 may optionally be attached to side panels 164 so that it extends around the perimeter of the parrallelepiped defined by legs 16, 18, 20 and 22, and cord 170 may be attached to slide brackets, such as slide bracket 44. Side panels 164 may then be secured to cord 170 by means of connectors 174. The user may finally pass guy cords 182 through slits (not shown) in screen 176 so that cords 182 may be staked at a desired location and locking rings 180 moved into position to firmly support canopy shelter 10 in a firm manner. Canopy shelter 10 is collapsed by reversing this procedure.

Figure 9:
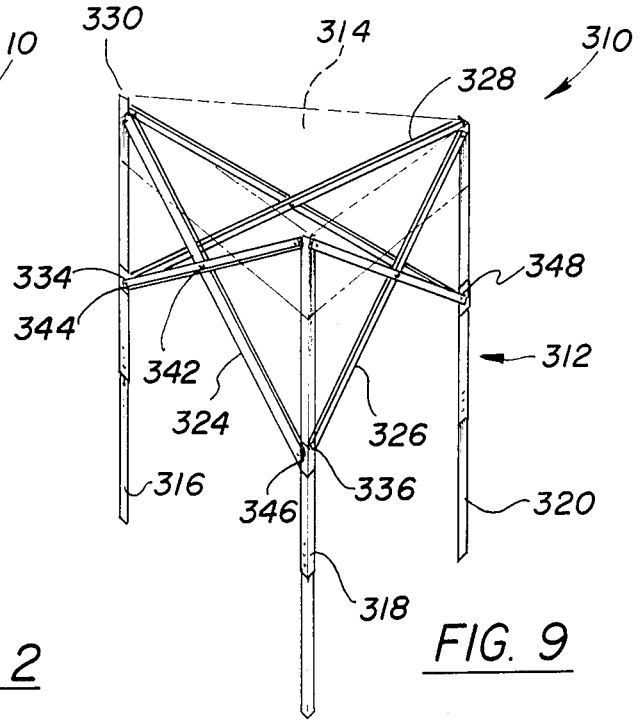
FIG. 9 is a perspective view of the support framework according to a second, most general, alternate embodiment of the present invention.
Figure 8:
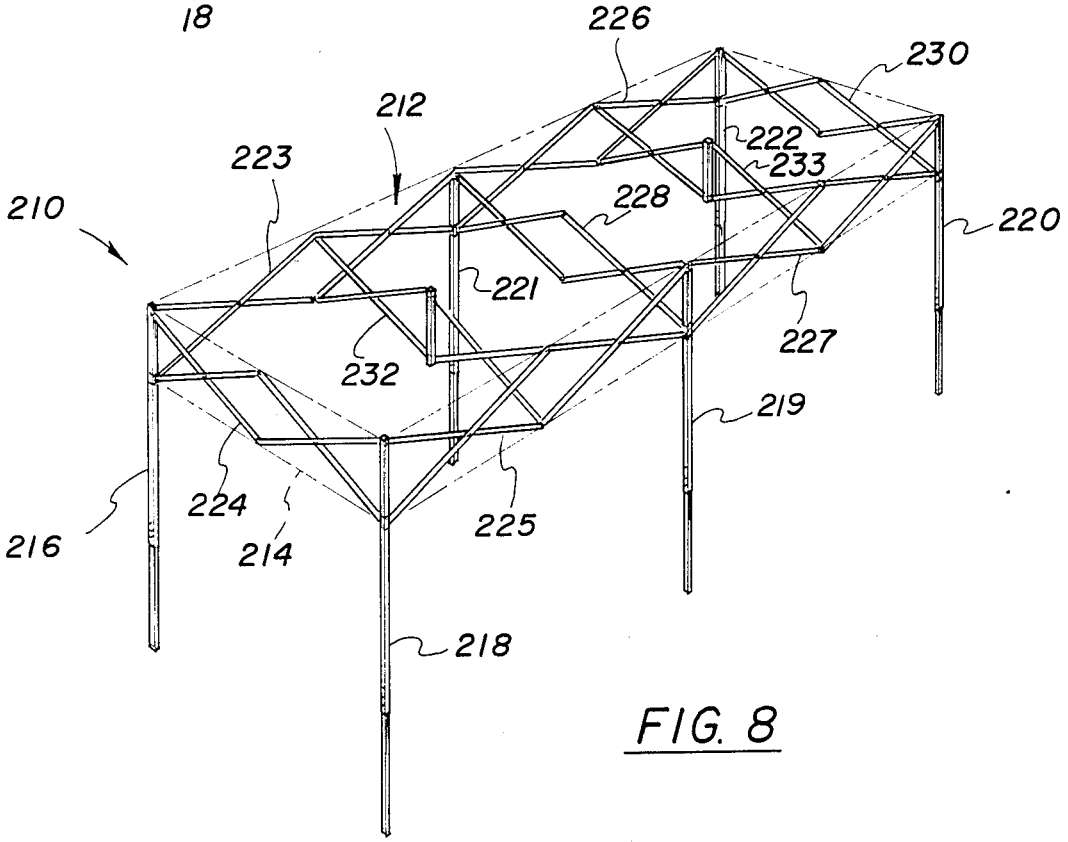
FIG. 8 is a perspective view of the support framework according to a first alternate embodiment of the present invention.

While the above description is directed to the preferred embodiment of the present invention, it should be understood that there are other geometrical configurations and structures which are contemplated by the scope of this invention. Indeed, a shelter having virtually any number of sides may be constucted. Two alternate embodiments of the present invention are shown in FIGS. 8 and 9 by way of example. These structures, though, incorporate the underlying principles as those discussed and described with respect to the preferred embodiment of the present invention.

In FIG. 8, a canopy shelter 210 is shown and which is provided to cover a larger, rectangular area of shelter than that described with respect to square-shaped canopy shelter 10. In FIG. 8, canopy shelter 210 is formed by a support framework 212 which includes four corner support members 216, 218, 220 and 222. Each of these corner support members or legs are constructed similarly to that described with respect legs 16, above. Legs 216 and 218 are interconnected by means of scissor assembly 224 formed of two X-shaped scissor units similar to scissor units 34 and 36. Likewise, legs 220 and 222 are interconnected by means of scissor assembly 230.

The structure shown in FIG. 8, though, a side support member or leg 219 is positioned midway between legs 218 and 220, and a side support or leg 221 is positioned midway between legs 216 and 222. Legs 218 and 219 are interconnected by means of scissor assembly 225, and legs 219 and 220 are interconnected by means of scissor assembly 227. Likewise, legs 216 and 221 are interconnected by means of scissor assembly 223, and legs 221 and 222 are interconnected by means of scissor assembly 226, with all of the scissor assemblies being similar to those described above. Legs 219 and 221 are interconnected by means of scissor assembly 228. Finally, scissor assemblies 223 and 225 are interconnected by means of a scissor assembly and post system 232 which is the same as scissor assembly 32 described with respect to the preferred embodiment. Scissor assemblies 226 and 227 are interconnected by a scissor and post assembly 233 which is also the same as scissor assembly 32. A flexible covering 214, shown in phantom, extends across the upper surface of the parallelepiped defined by support framework 212.

From the description provided with respect to FIG. 8, it should be appreciated that a support framework may be formed so that the canopy covering will protect generally any desired rectangular surface area with the larger support structure being formed in modules generally in the form of framework 12, such as shown in FIG. 3.

The simplest canopy shelter contemplated by the present invention is shown in FIG. 9 wherein triangular area canopy shelter 310 is formed by support framework 312. Framework 312 includes three upright support members or legs 316, 318 and 320 which are of a type described with respect to leg 16 of the preferred embodiment. Leg 316 is interconnected with leg 318 by means of a single X-shaped scissor unit 324. Legs 318 and 320 are interconnected by scissor unit 326, and legs 316 and 320 are interconnected by scissor unit 328. Leg 316 is provided with a slide bracket 344, leg 318 is provided with a slide bracket 346, and leg 320 is provided by a similar slide bracket 348. A canopy covering 314, shown in phantom, extends across the top of support framework 312 to provide protection against sun and rain.

It should be appreciated that each scissor unit is attached to the upper end brackets and to the slide bracket of its respective legs. For purposes of description, scissor unit 324 is connected at its upper corners to top 330 of leg 316 and top 332 of leg 318. At bottom corner 334, scissor unit 324 is secured to slide bracket 344, and scissor unit 324 is secured to slide bracket 344 at corner 336. Scissor unit 324 is thus formed of a pair of elongated arms which are hinged at a midpoint 342 thereon. Naturally, any number of X-shaped scissor units could be interconnected in end-to-end relationship between the pairs of legs, if desired.

Accordingly, the present invention has been described with some degree of particularly directed to the preferred embodiment of the present invention. It should be appreicated, though, that the present invention is defined by the following claims construed in light of the prior art so that modifications or changes may be made to the preferred embodiment of the present invention without departing from the inventive concepts contained herein.

I claim:

1. A collapsible canopy shelter adapted to be erected on the ground at a desired location, comprising:

four upright corner support members defining a parallelepiped, each corner support member having a top section and a bottom ground-engaging end;

a slide bracket slideably received on each corner support member and movable therealong;

an edge scissor assembly interconnecting adjacent ones of said corner support members whereby two pairs of facing scissors assemblies are formed, each said edge scissor assembly oriented in a generally vertical plane and interconnecting the slide brackets and the top sections of its associated corner support members and operative to move its respective corner support members away from one another into an expanded position when its said slide brackets are moved toward the tops of their respective corner support members and to move its respective corner support members toward one another into a collapsed position when its said slide brackets are moved toward the bottom ends of their respective corner support members;

an internal scissor assembly extending between and connected to at least one pair of facing scissors assemblies and operative to expand and contract in response to expansion and contraction of said one pair of facing scissors assemblies;

releaseable latch means on each said corner support member for releaseably retaining its respective slide bracket in at a location corresponding to the expanded position;

a flexible covering sized to extend across the top sections of said corner support members when they are in the expanded position to define a top surface of said parallelepiped; and an upright interior post engaged with and supported by said interior scissor assembly whereby the expansion of the internal scissor assembly allows said interior post to be positioned to positively support a central portion of flexible covering against the internal scissor assembly when said canopy shelter is in the expanded position, said internal scissor assembly including a socket moveable toward said flexible covering when the corner supports are moved into the expanded positon and a sleeve member connected thereto, said post received by said sleeve and positively engaged by said socket whereby said post is held in position against said central portion of said covering.

2. A collapsible canopy shelter adapted to be positioned on the ground, comprising:

a plurality of upright corner support members each having a top and bottom and oriented to define vertical edges of a selected geometric configuration;

a slide bracket slideably mounted on each of said corner support members and moveable therealong;

an edge scisor assembly interconnecting adjacent ones of said corner support members, each respective edge scissor assembly oriented in a generally vertical plane and having one portion pivotally secured to the top of its associated corner support members and another portion pivotally secured to the slide bracket of its associated corner support members, said edge scissor assemblies operative to expand and contract whereby its associated corner support members are caused to move away from and toward one another to vary the dimensions of said geometric configuration, said canopy shelter being in an expanded position when said corner support members are moved away from one another and in a collapsed position when said corner support members are moved toward one another;

an internal scissor assembly extending across said geometric configuration and connected between at least two of said edge assemblies and operative to expand and contract in response to expansion and contraction of said edge scissor assemblies, said internal scissor assembly including a lower socket and an upper sleeve secured to said internal scissor assembly;

first releasable latch means on each said corner support members for releasably retaining its respective slide bracket adjacent the top of its respective corner support member to retain said canopy shelter in the expanded position;

a flexible covering extending across the top of said corner support members and sized to cover the upper surface of said geometric configuration when said canopy shelter is in the expanded position; and an upright interior post secured to the internal scissor assembly and operative to positively support a central portion of said flexible covering when said canopy shelter is in the expanded position, said post slideably received in said upper sleeve and positively supported by said lower socket whereby said lower socket holds said post against the central position of the flexible covering when said canopy shelter is in the expanded position.

3. A collapsible canopy shelter adapted to be positioned on the ground, comprising:

a plurality of upright corner support members each having a top and bottom and oriented to define vertical edges of a selected geometric configuration;

a slide bracket slideably mounted on each of said corner support members and moveable therealong;

an edge scissor assembly interconnecting adjacent ones of said corner support members, each respective edge scissor assembly oriented in a generally vertical plane and having one portion pivotally secured to the top of its associated corner support members and another portion pivotally secured to the slide bracket of its associated corner support members, said edge scissor assemblies operative to expand and contract whereby its associated corner support members are caused to move away from and toward one another to vary the dimensions of said geometric configuraiton, said canopy shelter being in an expanded position when said corner support members are moved away from one another and in a collapsed position when said corner support members are moved toward one another;

an internal scissor assembly extending across said geometric configuration and connected between at least two of said edge assemblies and operative to expand and contract in response to expansion and contraction of said edge sicssor assemblies;

first releasable latch means on each said corner support members for releasably retaining its respective slide bracket adjacent the top of its respective corner support member to retain said canopy shelter in the expanded position;

a flexible covering extending across the tops of said corner support members and sized to cover the upper surface of said geometric configuration when said canopy shelter is in the expanded position, said covering including a top panel extending across said upper surface and side panels connected to said top panel and extending downwardly alongside surfaces of said geometric configuration;

means along the lower edge of said side panels for releaseably securing said side panels to said corner support members; and an upright interior post secured to the internal scissor assembly and operative to positively support a central portion of said flexible covering when said canopy shelter is in the expanded position.

4. A collapsible canopy shelter according to claim 3 wherein said means for releaseably securing said side panels includes a flexible cord extending around an upper portion of each corner support member in the expanded position and includes releaseable connectors mounted on said side panels and adpated to receive said flexible cord.

5. A collapsible canopy shelter according to claim 4 wherein said slide bracket includes a mounting ring adapted to secure said flexible cord thereto.

* * * * *

UNITED STATES PATENT AND TRADEMARK OFFICE

CERTIFICATE OF CORRECTION

PATENT NO. : 4,641,676

DATED : February 10, 1987

INVENTOR(S) : James P. Lynch

It is certified that error appears in the above-identified patent and that said Letters Patent is hereby corrected as shown below:

On The Title Page Item [56] insert -- OTHER PUBLICATION

"World's Fastest" Shelter, International Corp. --.

Signed and Sealed this

Twenty-first Day of November, 1989

*Attest:*

JEFFREY M. SAMUELS

*Attesting Officer*

*Acting Commissioner of Patents and Trademarks*